US007316520B2

(12) United States Patent
Grubba

(10) Patent No.: US 7,316,520 B2
(45) Date of Patent: Jan. 8, 2008

(54) LOW SURFACE AREA SHEARING DEVICE

(75) Inventor: Bill Grubba, Terre Haute, IN (US)

(73) Assignee: SemMaterials, L.P., Tulsa, OK (US)

( * ) Notice: Subject to any disclaimer, the term of this patent is extended or adjusted under 35 U.S.C. 154(b) by 0 days.

(21) Appl. No.: 10/419,421

(22) Filed: Apr. 21, 2003

(65) Prior Publication Data

US 2004/0208699 A1 Oct. 21, 2004

(51) Int. Cl.
*E01C 23/07* (2006.01)

(52) U.S. Cl. ..... 404/84.05; 404/83; 404/84.1; 404/84.5; 404/92; 404/101; 404/108; 404/110; 404/115; 404/118

(58) Field of Classification Search ..... 404/118, 404/84.8, 84.1–84.5, 101, 84.05–84, 83, 404/92, 108, 110, 115; 172/2
See application file for complete search history.

(56) References Cited

U.S. PATENT DOCUMENTS 3,403,609 A * 10/1968 Bradshaw et al. ..... 404/105
3,561,334 A 2/1971 Gerosa et al.
3,843,274 A * 10/1974 Gutman et al. ..... 404/91
4,014,525 A 3/1977 Oda et al.
4,708,516 A 11/1987 Miller
4,924,374 A 5/1990 Middleton et al.
5,000,615 A 3/1991 Murray
5,201,603 A * 4/1993 Bassett et al. ..... 404/84.1
5,201,604 A * 4/1993 Ferguson et al. ..... 404/110
5,258,961 A 11/1993 Sehr et al.
5,340,214 A 8/1994 Juzwiak
5,362,176 A * 11/1994 Sovik ..... 404/72
5,393,167 A * 2/1995 Fujita et al. ..... 404/84.1
5,460,649 A * 10/1995 Strassman ..... 106/668
5,512,093 A 4/1996 Huege et al.
5,588,776 A 12/1996 Swisher, Jr. et al.
5,653,552 A 8/1997 Wiley et al.
5,752,783 A * 5/1998 Malone ..... 404/84.2
6,027,282 A * 2/2000 Horn ..... 404/75
6,033,147 A 3/2000 Richter
6,036,353 A 3/2000 Paetzold (Continued)

OTHER PUBLICATIONS

Midland Machinery Co., Inc. Mix Trailers; T-Series; http://www.midlandmachinery.com/mix-trailers.htm; 2 pages; Dec. 17, 2001.

(Continued)

*Primary Examiner*—Raymond W Addie
(74) *Attorney, Agent, or Firm*—Stinson Morrison Hecker LLP

(57) ABSTRACT

An apparatus for use in shearing paving material applied to a surface is provided. This apparatus includes a blade for shearing the asphalt mixture to a desired thickness, cylinders for raising and lowering the blade in response to elevational changes in the surface, at least one signal generator associated with each cylinder and adapted to produce a signal indicative of the elevation of the surface, and at least one signal receiver associated with each signal generator. This blade apparatus is coupled with a prime mover. The receiver is operable to activate the cylinders in response to a signal received from the generator. The blade is raised and lowered as the elevation of the surface changes in response to signals emanating from the generator allowing surface level variations to be evened out while paving.

20 Claims, 6 Drawing Sheets

U.S. PATENT DOCUMENTS

| | | | | |
|---|---|---|---|---|
| 6,079,901 | A | 6/2000 | Banks et al. | |
| 6,227,761 | B1 * | 5/2001 | Kieranen et al. | 404/84.5 |
| 6,238,135 | B1 * | 5/2001 | Rower | 404/84.5 |
| 6,530,721 | B2 * | 3/2003 | Yost | 404/84.5 |
| 6,554,080 | B2 | 4/2003 | Horner | |
| 6,672,797 | B1 | 1/2004 | Zachman et al. | |

OTHER PUBLICATIONS

Midland Machinery Co., Inc.; Manufacturers of Road Maintenance Equipment; http://www.midlandmachinery.com/nova-paver.htm; 6 pages; Dec. 17, 2001.

Midland Machinery Co., Inc.; ARRA New Technology Session; www/midlandmachinery.com/arra_new_technology_session.htm; 2 pages; Dec. 17, 2001.

Midland Machinery Co., Inc.; Mix-Paver® 800; http://www.midlandmachinery.com/mix-paver.htm; 2 pages; Dec. 17, 2001.

Midland Machinery Co., Inc.; http://www.midlandmachinery.com/Diag_B.htm; 1 page; Dec. 17, 2001.

Midland Machinery Co., Inc.; http://www.midlandmachinery.com/Diag_A.htm; 1 page; Dec. 17, 2001.

Aggregates & Roadbuilding: Canada's "Rock to Road" Magazine; Urban roads—a growing market for cold-in-place recycling; http://www.rocktoroad.com/urbanroads.htm; 5 pages; Dec. 17, 2001.

Asphalt Contractor; Bergkamp's M1 continuous Micro-surfacing paver; http://www.asphalt.com/HHIW/bergkamp.html; 2 pages; Dec. 17, 2001.

* cited by examiner

LOW SURFACE AREA SHEARING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to an apparatus that includes a blade for leveling paving material. More specifically, the apparatus includes a signal generator for measuring the elevation of a road so that the blade can be adjusted to create a more planar road.

Blades have not been used to level viscous asphalt mixtures such as substantially solventless and/or cold asphalt mixtures. Instead, blades are used for grading roads before mix is laid rather than being used to lay the mix.

Screeds have been used to even out paving material as it is being applied to a surface. The disadvantage with traditional screeds is that they do not work well for spreading solventless and/or cold mix, which can be quite viscous. While laying such mixtures, screeds grab and pull the mix as it is being applied.

Conventional adjustment mechanisms for screeds, whether manual or electronic, change the tilt or angle of attack of the screed but do not lift the screed. In order to continue to lay a planar road when the stiffness of the paving mixture increases, the forward speed of the screed must be slowed or the angle of attack of the screed must be adjusted. Even in doing either or both, the ride of the finished pavement is compromised.

Lift cylinders adjust the downward pressure of the screed and raise it for mobilization. After the screed is lifted up by the cylinders, it floats in a downward direction being pulled by the weight of the screed. It floats on the pavement mixture because of the upward force induced by the mixture but is never in suspension.

Some screeds are manually adjusted in response to elevational changes in the road. However, this delayed adjustment merely exaggerates the elevational changes creating more severe raised sections and indentations in the road.

In order to overcome these disadvantages, a device for evening out sections of mix placed on high and low elevations of a road is needed. More specifically, this device should be significantly more responsive to changes in the elevation of the road than conventional devices.

SUMMARY OF THE INVENTION

It is an object of the present invention to provide an apparatus for laying high modulus asphalt mixtures so as to create a road surface with more desirable ridability.

It is another object of the present invention to provide an apparatus for measuring the elevation of a road so that the blade of the apparatus can be adjusted to create a more planar road.

It is a further object of the present invention to provide an apparatus with a blade that is more responsive to the elevational changes of the road so that bumps and surface imperfections of a road can be evened out.

According to the present invention, the foregoing and other objects are achieved by an apparatus for use in laying high modulus asphalt mixtures on a surface. This apparatus includes a strike blade for shearing the asphalt mixture to a desired thickness, cylinders for raising and lowering the blade in response to elevational changes in the surface, and at least one signal generator associated with the cylinders and adapted to produce a signal indicative of the elevation of the surface, and at least one signal receiver associated with the signal generator and cylinders. The blade apparatus discussed above is coupled with a prime mover. The receiver is operable to activate the proximity control device in response to a signal received from the signal generator. The blade is raised and lowered in response to signals emanating from the signal generator, as the elevation of the surface changes.

Additional objects, advantages and novel features of the invention will be set forth in part in the description which follows, and in part will become apparent to those skilled in the art upon examination of the following or may be learned from the practice of the invention.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF PREFERRED EMBODIMENT

Figure 1:
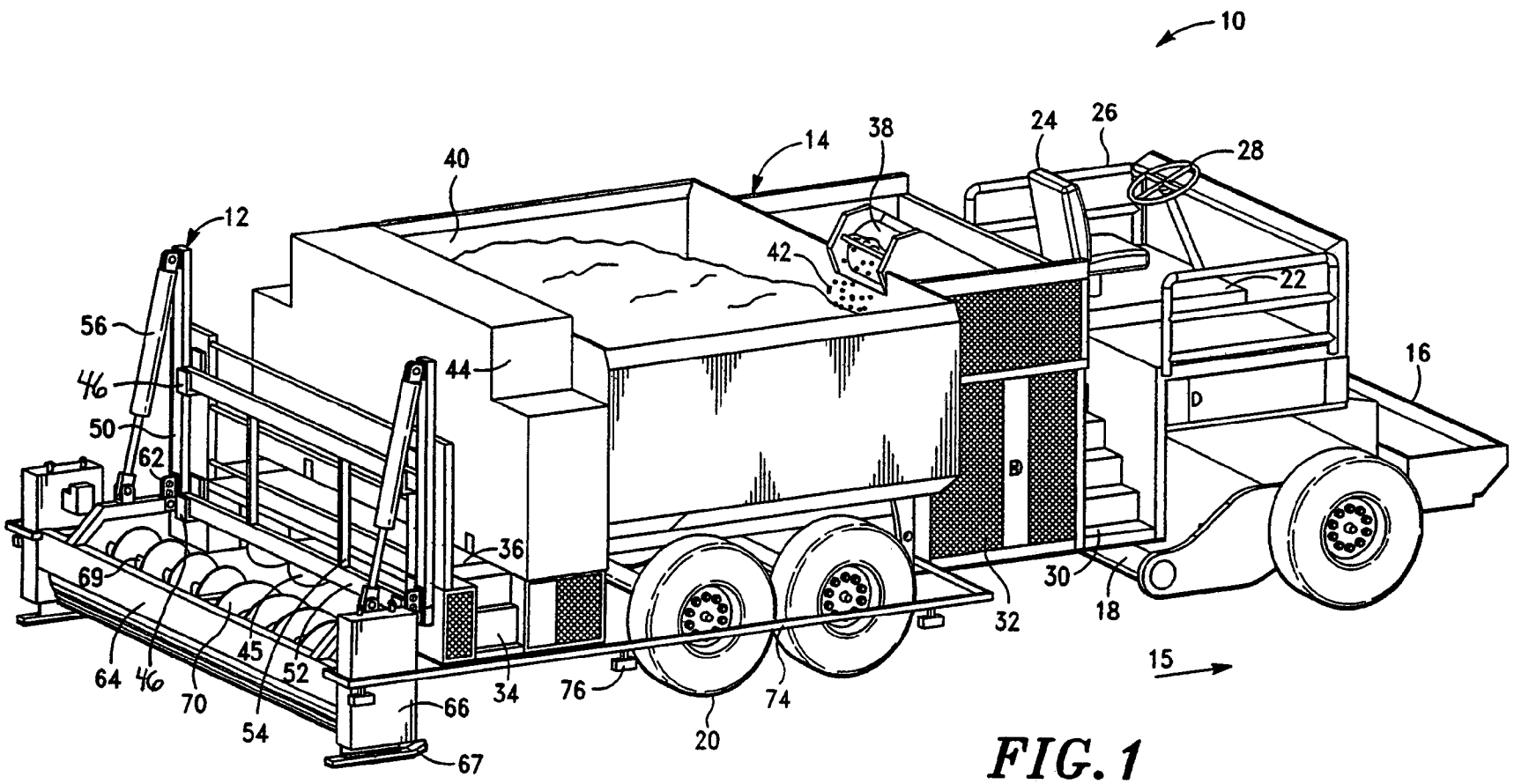
FIG. 1 is a perspective view of the apparatus of the present invention.

Referring to FIG. 1, an apparatus for use in applying a paving material to a surface is broadly designated by reference numeral 10. Apparatus 10 includes an attachment 12 coupled with a prime mover 14. The direction of travel of apparatus 10 is indicated by arrow 15. Prime mover 14 includes a bin 16 for receiving aggregate, which is located at the front of the vehicle. Bin 16 is coupled with a chassis 18 of the prime mover 14. Only parts of chassis 18 are shown in FIG. 1. Wheels 20 are also coupled with chassis 18. Still further, platform 22, which supports a chair 24 and railing 26, is supported by chassis 18 of the prime mover. A steering wheel 28 is coupled with wheels 20 and allows a driver sitting in seat 24 to control the direction that prime mover 14 is moved. Stairs 30, which are also supported by chassis 18, lead to platform 22. The engine (not shown) of prime mover 14 is behind access panels 32. Prime mover 14 has a second set of stairs 34 leading to a back platform 36. Back platform 36 allows a second operator to access further controls for moving the prime mover and its attachment.

An aggregate conveyor 38 transfers aggregate from bin 16 to a second bin 40. Aggregate 42 is shown entering bin 40. A fines feed bin 44 is coupled to the back of bin 40. The emulsion/water tank on the vehicle is not shown. The aggregate and emulsion are mixed together, and fines feed, such as cement and/or lime, from bin 44 may be added to the mixture before it is distributed on the ground. Pugmill 45 distributes asphalt mixture in front of the auger of attachment 12.

As shown in FIG. 1, brackets 46 are secured to prime mover 14. Attachment 12 is fixedly held by brackets 46 of prime mover 14 so that it is an integral part of prime mover 14. Attachment 12, which has a blade 80, is not attached to the prime mover 14 using tow arms so that blade 80 floats behind prime mover 14 but instead blade 80 is suspended at all times.

Figure 2:
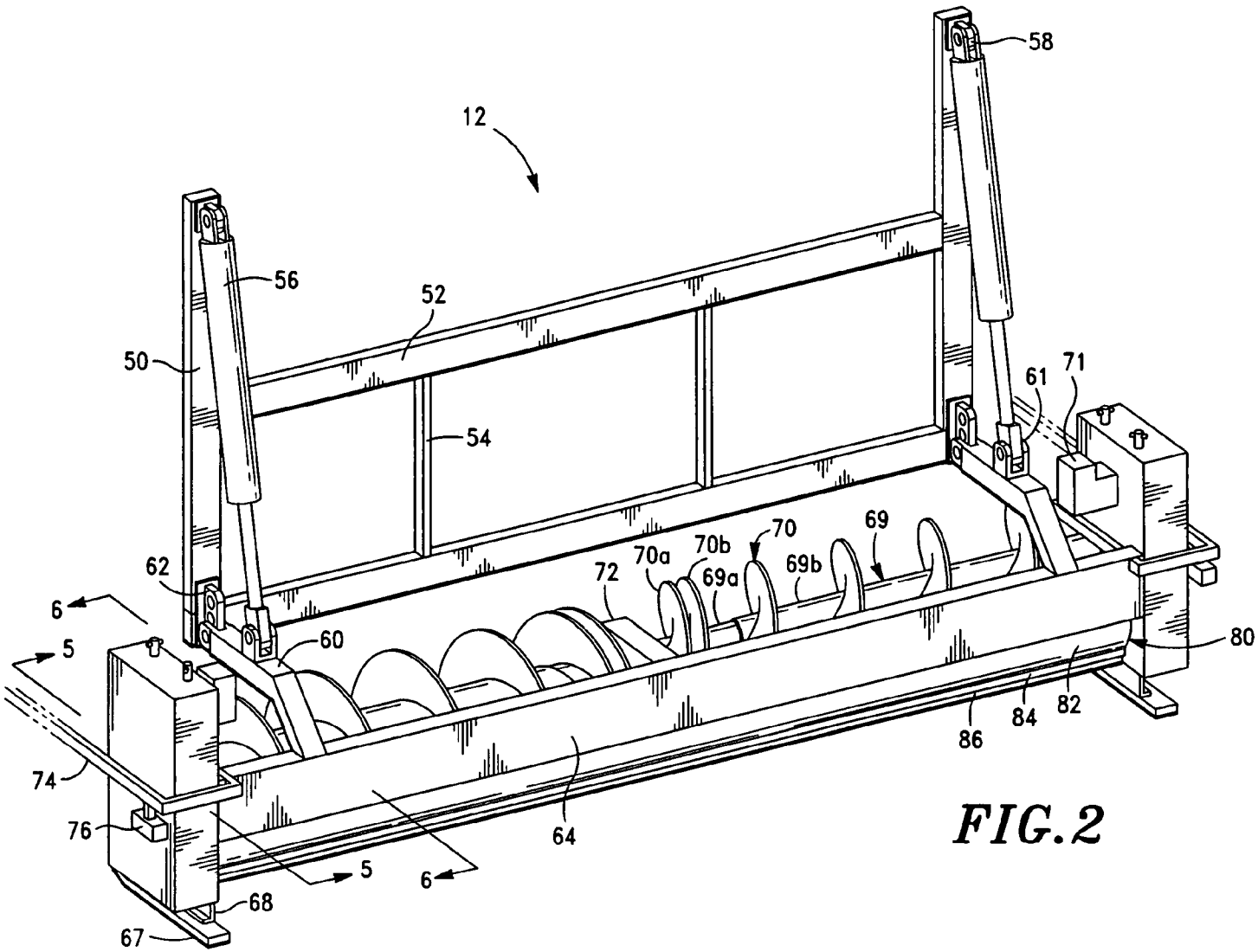
FIG. 2 is a perspective view of the blade control device attachment of the present invention, which is part of the apparatus shown in FIG. 1.
Figure 3:
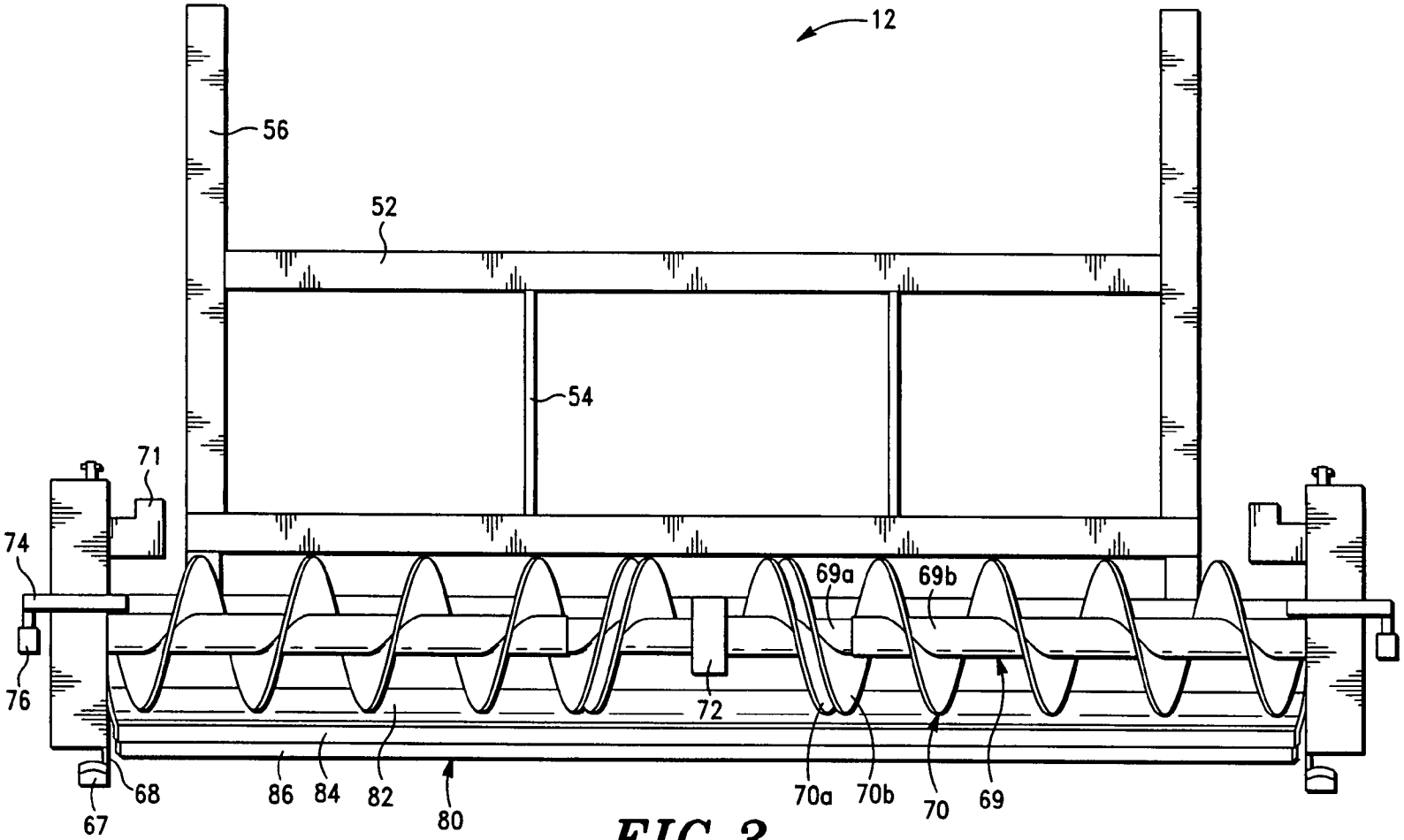
FIG. 3 is a back elevational view of the attachment shown in FIG. 2.
Figure 4:
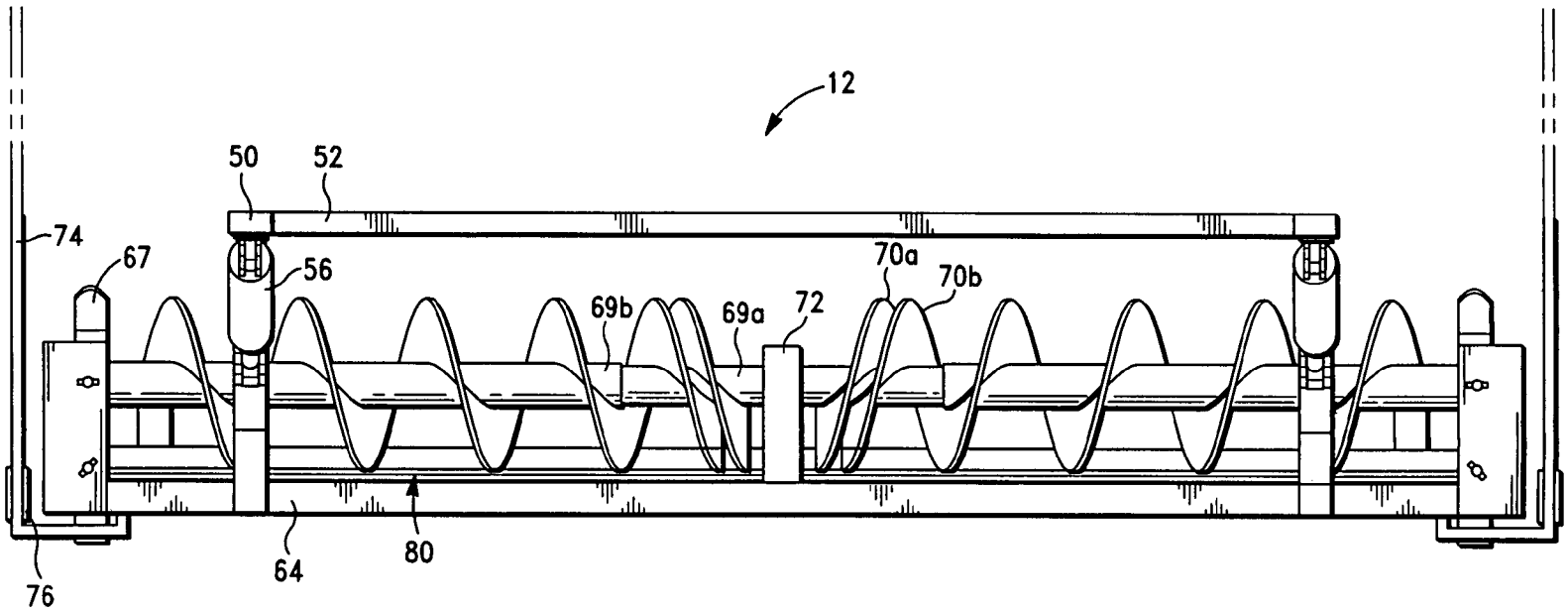
FIG. 4 is a top view of the attachment shown in FIG. 2.

Referring to FIGS. 2-4, attachment 12 includes vertical supports 50 that are coupled together by crossbars 52. Slats 54 provide structural support between crossbars 52. Cylinders 56 are coupled with vertical supports 50 via brackets 58 at one end. The opposite ends of cylinders 56 are coupled with pivot arms 60, each of which has a bend in it, via brackets 61. Each pivot arm 60 is coupled with vertical support 50 via a multiple pin hinge 62. Pivot arm 60 can be adjusted by securing it to support 50 using different holes in hinge 62 so as to change the angle of attack of attachment 12 with respect to the ground. The opposite end of each pivot arm 60 is coupled with a frame 64.

Figure 5:
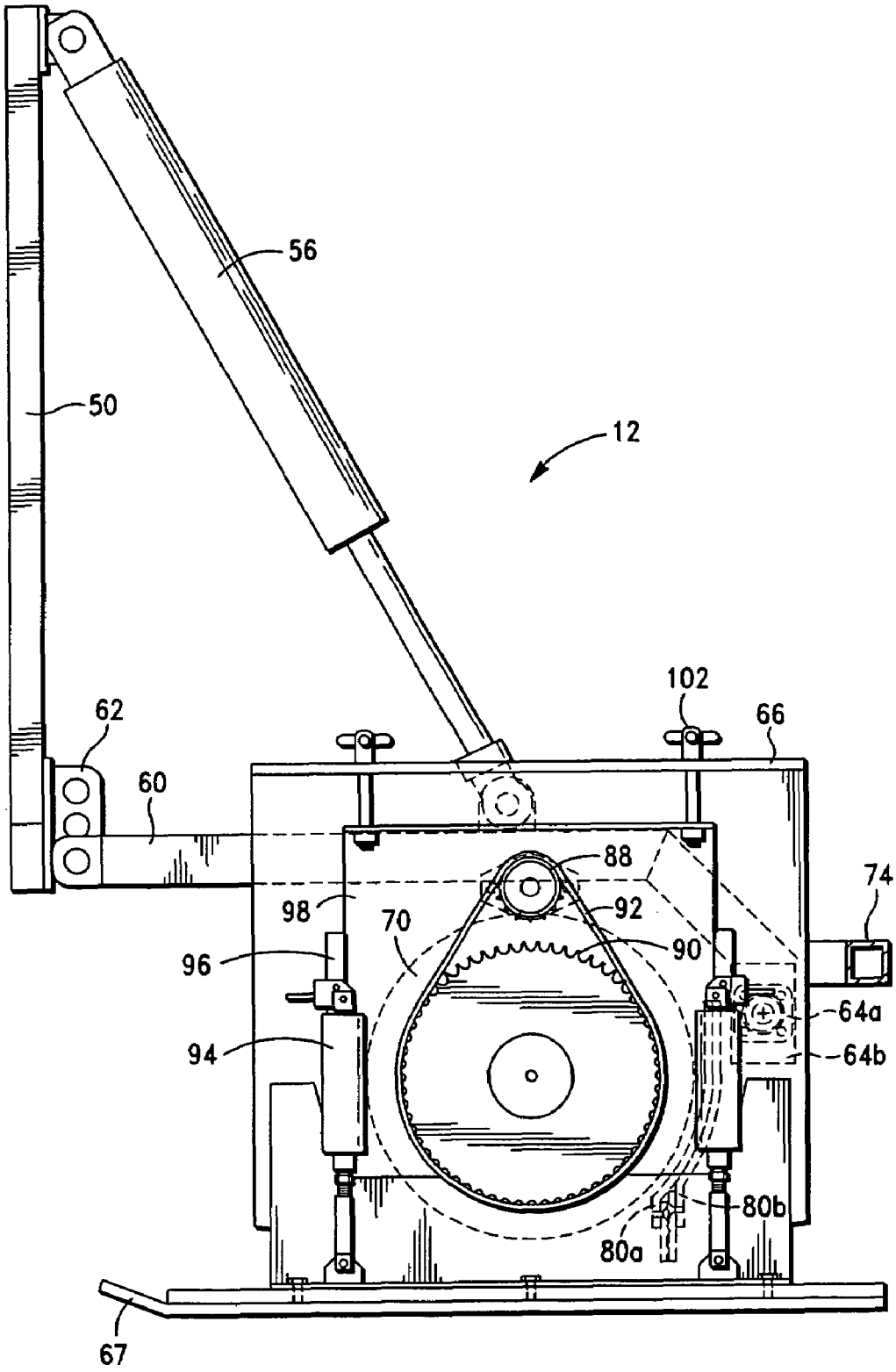
FIG. 5 is a cross-sectional view of the attachment shown in FIG. 2 taken along line 5-5 of FIG. 2.
Figure 6:
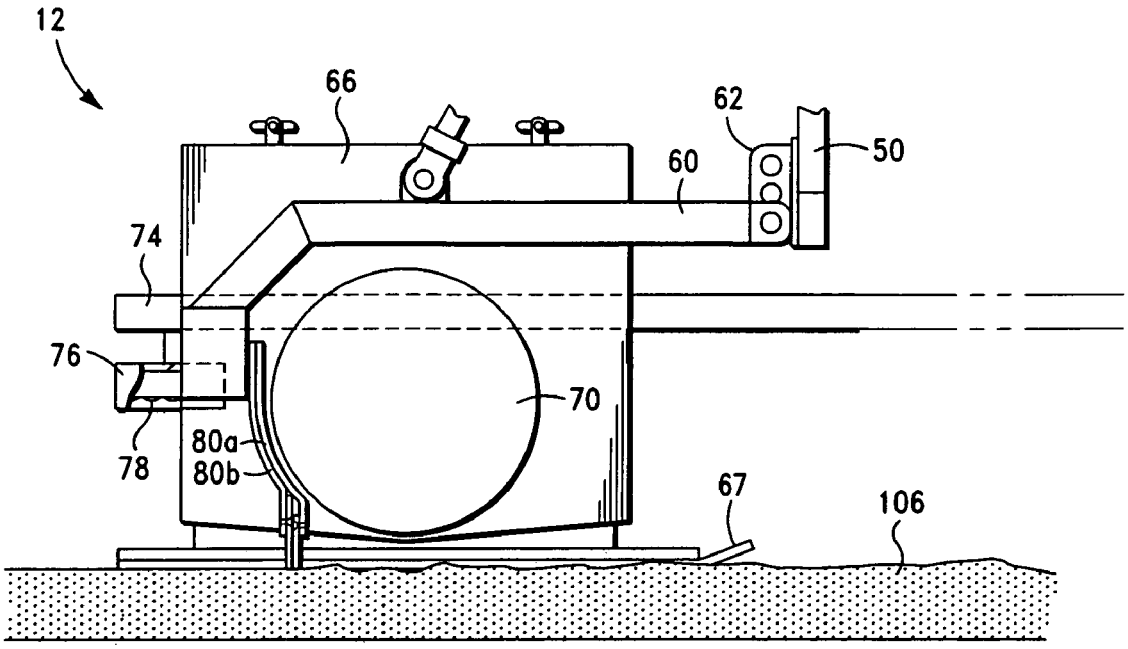
FIG. 6 is a cross-sectional view of the apparatus shown in FIG. 2 taken along line 6-6 of FIG. 2.

Frame 64 is coupled with gear boxes 66 on each of its sides. Gear boxes 66 rest on skis 67 via L-bracket 68, as best shown in FIG. 5. A shaft 69 is coupled with gear boxes 66 and rotated by motor 71, as best shown in FIGS. 2-4. An auger 70 surrounds shaft 69 and is turned as the shaft rotates. Center support 72 helps to hold shaft 69. Brackets 74 are coupled with frame 64 and chassis 18. Signal boxes 76 extend from brackets 74. Preferably, these signal boxes 76 contain multiple sensors 78 therein. Sensors 78 are shown in FIG. 6. As shown in FIG. 6, the bottom of signal box 76 is open so that sensors 78 can send signals to the ground being paved.

A blade 80 is coupled with frame 64. Blade 80 includes a contour plate 82 and a strike blade 84. A wear strike 86 is viced to strike blade 84. Preferably, blade 80 is no more than 5 feet from pugmill 45. Cylinders 56 raise or lower blade 80 in response to signals received by sensors 78. Cylinders 56 also can change the angle of attack of blade 80.

Frame 64, shaft 69, auger 70, and blade 80 can be extended in a direction substantially perpendicular to the direction of travel so as to distribute and level more asphalt mixture in a single pass. More specifically, shaft 69 includes a shaft 69*a*, which is telescopically received by a shaft 69*b*. A first pair of shafts 69*a* and *b* are on one side of center support 74 and a second pair of shafts 69*a* and *b* are on the opposite side of the center support. Auger 70 includes augers 70*a* and 70*b*, which separate from each other as shafts 69*a* and 69*b* extend. As shown in FIGS. 5 and 6, blade 80 is comprised of blade 80*a* and blade 80*b*, which overlap each other in various amounts depending upon how much shaft 69 is extended. The telescoping of frame 64 is best shown in FIG. 5 and is represented by 64*a* and 64*b*.

As shown in FIG. 5, within each gear box 66, is a drive gear 88 that is coupled with an auger gear 90 via a chain 92. The auger gear turns shaft 69 so as to turn auger 70 and distribute asphalt. Cylinders 94 are coupled to ski 67 at one end and bracket 96 at the other end. Bracket 96 receives a plate 98. Plate 98 is coupled with box 66 via screws 102. Cylinder 94 provides pressure to keep skis 67 on the ground.

Gear boxes 66 serve to confine the asphalt mix from running out of the sides of attachment 12. Preferably, attachment 12 includes more than one signal box on each side of gear boxes 66. For instance, one preferable embodiment includes three signal boxes, as shown in FIG. 1. Furthermore, preferably, each signal box 76 includes a plurality of sensors 78 therein, which generate and receive signals. Most preferably, at least about five sonar sensors are within each box. Box 76 has an open bottom allowing signals from sensors 78 to be sent to detect the elevation of the ground. Sensor 78 then receives a signal in response to the signal sent, and this signal is processed. The control valve is coupled to gear box 66 and cylinder 56 and moves blade 80 in response to signals from sensors 78.

Figure 7:
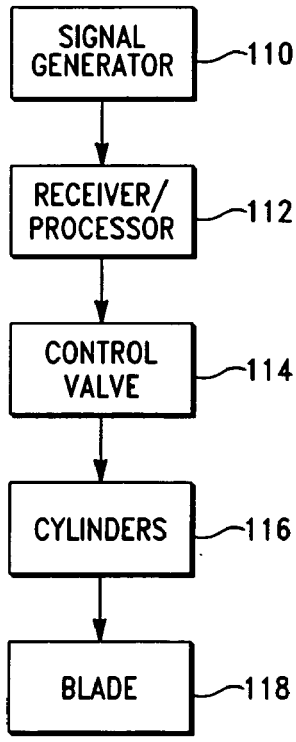
FIG. 7 is a flow diagram showing how the signals is generated and received by the apparatus of the present invention are processed.

The control mechanism between sensors 78 and blade 80 is illustrated in FIG. 7. A signal is generated in a signal generator station 110. It is sent to a receiver/processor station 112. Receiver/processor station 112 sends a signal to a control valve station 114 where a cylinder station 116 is controlled. Preferably, control valve station 114 includes a servo valve. Cylinder station 116 then is able to effect the movement of a blade station 118.

Preferably, the sonar sensors span no more than about 12 feet in a direction of travel. Still further, each of the sonar sensors should be within about 2 feet of the sides of the apparatus. Preferably, any signals that are averaged with each other should be within about 14 inches per unit and any signals averaged between units should be within 25 feet of each other. The signals may be compared to a fixed baseline.

Any shearing device may be used in place of blade 80. The shear device may include devices having less surface area in contact with the ground than a screed and capable of shearing an asphalt mixture. Preferably, the shearing device is a blade and is concave with respect to the direction of travel of the vehicle. Any proximity control device may be used in place of cylinders 56. For instance, a motorized pulley system may be the proximity control device. Preferably, the proximity control device includes 2 hydraulic bi-directional cylinders.

A paving mixture 106, as shown in FIG. 6, is applied at a thickness of about ⅜ to 3½ inches. The shearing device may be at about a 60° to 120° angle with respect the road. Preferably, the shearing device is angled while shearing the paving material so that the paving material slopes downward to the road's edge for drainage purposes. Preferably, the shearing device is a blade and is concave with respect to the direction of travel of the apparatus. The shearing device should be within 6 inches of the auger. Preferably, it is within 3 inches of the auger. Most preferably, the auger is within 1 inch of the shearing device.

In operation, prime mover 14 travels forward in a direction of travel 15. Prime mover 14 dispenses paving mixture 106 on the road. Attachment 12 follows behind prime mover 14 in the direction of travel 15. As prime mover 14 is moving forward, sensors 78 send signals to the roadway to measure its elevation. Preferably, there are signal boxes 76 that contain sensors 78 on both gear boxes 66 so that the center of the road and the edge of the road are measured. Preferably, there are multiple sensor boxes on each side so that upcoming changes in the road can be measured and so that these measurements can be averaged so as to gradually slope any inclines. The signals received from the sensors are transmitted to a signal receiver, where the multiple signals are averaged. They may be weight averaged if desired. The receiver then sends a signal to a control valve (not shown) that controls cylinders 56. The control valve is controlled by signals from sensors 78. Cylinders 56 move blade 80 downward in response to a raised section in the road so as to create a more planar road. Alternatively, in response to receiving a signal that a section of the road is indented, a signal may be sent to control valve to cylinder 56 so as to move blade 80 upward to fill in the indentation. Blade 80 may be moved instantaneously while prime mover 14 is moving in response to elevational changes of the ground. Unlike screeds, blade 80 is suspended at all times. The apparatus of the present invention can be stopped and started without causing indentations to be created in the roadway.

The receiver controls the height and slope of the blade, based on the elevation of the ground as determined by the sensors. The blade is instantaneously and proportionally raised or lowered in response to the elevation of the surface being paved. Optionally, the generation of signals may be stopped and the blade controlled in a manual mode.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

I claim:

1. An apparatus for shearing an asphalt mixture on a surface, said apparatus comprising:

a prime mover that provides a pugmill for dispensing said asphalt mixture wherein said prime mover has brackets secured thereto; and an implement having a framework that is fixedly held by said brackets of said prime mover wherein said implement has no wheels and wherein said apparatus has no wheels that travel behind said implement, wherein said implement is comprised of:

(a) a blade capable of shearing said asphalt mixture on said surface wherein said blade is moveable while said framework of said implement remains fixedly held;

(b) a proximity control device coupled with said blade for directly raising and lowering said blade in response to elevational changes in said surface wherein said proximity control device and said blade are not coupled using tow arms and said blade is not raised and lowered through a tow point;

(c) at least one signal generator associated with said proximity control device and adapted to produce a signal indicative of the elevation of said surface; and (d) at least one signal receiver associated with said proximity control device and said signal generator, whereby said blade is raised or lowered substantially instantaneously as said surface elevation changes in response to signals emanating from said generator.

2. The apparatus of claim 1, wherein said blade is no more than 5 feet from said pugmill.

3. The apparatus of claim 1, wherein said proximity control device comprises a cylinder for raising and lowering said blade.

4. The apparatus of claim 1, wherein said signal generator is a sonar generator and said signal receiver is a sonar receiver.

5. The apparatus of claim 1, wherein said blade is concave with respect to the direction of travel of said apparatus.

6. The apparatus of claim 1, wherein said blade is able to be proportionally raised or lowered in response to elevational changes in said surface.

7. The apparatus of claim 1, wherein said receiver controls the height and slope of said blade.

8. The apparatus of claim 1, wherein said blade is able to be extended in a direction that is substantially perpendicular to the direction of travel of said apparatus.

9. The apparatus of claim 1, further comprising:

confinement ends coupled with said framework of said implement for holding said asphalt mixture within said apparatus.

10. The apparatus of claim 9, wherein said signal generators are coupled with said confinement ends such that at least one generator is coupled with a first end and at least one generator is coupled with a second end.

11. The apparatus of claim 1, wherein said apparatus includes a plurality of signal generators and a plurality of signal receivers associated therewith.

12. The apparatus of claim 11, wherein said plurality of signals received by said signal receivers are averaged.

13. The apparatus of claim 1, wherein said implement is further comprised of (e) an auger capable of distributing said asphalt mixture before said mixture is sheared by said blade.

14. The apparatus of claim 13, wherein said auger is within 6 inches of said blade.

15. A method of leveling a surface using an apparatus comprised of a prime mover that provides a pugmill for dispensing an asphalt mixture and that has brackets secured thereto and an implement having a framework that is fixedly held by said brackets of said prime mover wherein said implement has no wheels and wherein said apparatus has no wheels that travel behind said implement, wherein said implement is comprised of a blade capable of leveling said asphalt mixture on said surface wherein said blade is movable while said framework of said implement remains fixedly held, a proximity control device coupled with said blade and not coupled using tow arms for directly raising and lowering said blade without raising and lowering through a tow point, and an auger, said method comprising:

(a) moving said apparatus in a direction of travel;

(b) applying an asphalt mixture to said surface while said apparatus is moving;

(c) adjusting the height of said blade so that it is raised and lowered substantially instantaneously as the elevation of said surface changes; and (d) leveling said asphalt mixture using said shearing device, wherein steps (a)-(d) are accomplished in a single pass.

16. The method of claim 15, wherein said apparatus is further comprised of a signal generator and a signal receiver associated with said proximity control device, said method further comprising:

measuring the elevation of said surface using a signal from said signal generator as said apparatus moves in said direction of travel; and processing said signal using a signal receiver.

17. The method of claim 16, further comprising:

measuring the altitude of said surface using a signal from said signal generator.

18. The method of claim 15, wherein said asphalt mixture is substantially diluent-free.

19. The method of claim 15, wherein said surface is dirt, gravel, asphalt, or combinations thereof.

20. The method of claim 15, further comprising:

stopping said apparatus from moving in said direction of travel; and starting said apparatus, wherein substantially planar movement of said blade is maintained during said stopping and starting steps.

* * * * *